US005671563A

United States Patent [19]

Marcum

[11] Patent Number: 5,671,563

[45] Date of Patent: Sep. 30, 1997

[54] VEHICLE CONTROL ARM DEVICE

[76] Inventor: Alfred Marcum, 3012 Cedar Point Rd., Crestwood, Ky. 40014

[21] Appl. No.: 136,155

[22] Filed: Oct. 15, 1993

[51] Int. Cl.[6] ..... E01F 3/68

[52] U.S. Cl. ..... 49/49; 404/10

[58] Field of Search ..... 49/34, 35, 140, 49/141, 9, 49; 404/6, 9, 10; 246/125, 130

[56] References Cited

U.S. PATENT DOCUMENTS

| | | | |
|---|---|---|---|
| 2,874,493 | 2/1959 | Mandel | 49/9 X |
| 4,219,969 | 9/1980 | Reinitz et al. | 49/141 |
| 4,364,200 | 12/1982 | Cobb | 49/49 X |
| 4,522,530 | 6/1985 | Arthur | 404/10 |
| 4,811,516 | 3/1989 | Anderson | 49/49 |
| 5,205,236 | 4/1993 | Hughes | 404/10 X |

*Primary Examiner*—Kenneth J. Dorner
*Assistant Examiner*—Jerry Redman
*Attorney, Agent, or Firm*—Wheat, Camoriano, Smith & Beres, PLC

[57] ABSTRACT

A vehicle control gate arrangement pivotable to a position for restricting flow of vehicular traffic where the gate is generally elongate and can include a tubular shell and a core member where the shell is more flexible than the core and contacts the core substantially continuously around the periphery of the core. The core can be terminated toward the distal end of the gate so that the shell extends outwardly from the termination of the core so that vehicles attempting to bypass the end of the gate but failing to do so, strike the flexible end of the gate so the gate is not damaged or knocked down. An arrangement is also provided to include a gate composed of one or more sections connected to an adjacent section or to a pivot by a joint assembly which releases the outermost section in the event the section is struck by a vehicle attempting to or accidently going through the gate.

13 Claims, 1 Drawing Sheet

FIG. 6A1

VEHICLE CONTROL ARM DEVICE

FIELD OF THE INVENTION

The present invention relates in general to vehicle crossing gates and more particularly to arrangements to reduce damage to such gates and to improve the effectiveness thereof.

BACKGROUND OF THE INVENTION

Vehicle control crossing gates are used in a variety of applications such as parking facilities and more particularly in connection with railroad crossings. It is well known that the gates provided at railroad crossings are lowered at the approach of a train and are intended to terminate traffic flow across the railroad track until the train has passed.

Often, vehicles at the crossing find it desirable or in some cases necessary to go around the crossing gate prior to the arrival of the train. Even though it is generally unlawful to bypass a lowered crossing gate the railroad operators find that gate bypassing is a very common occurrence. In order to bypass a lowered gate it is often necessary for a vehicle operator to weave through the crossing because the gate arms on opposite sides of the crossing generally extend to or past the center line of the road. In many cases the vehicle strikes the end of the gate arm which is usually on the passenger side of the vehicle where the operator cannot see clearly. The difficulty of maneuvering the vehicle through the space between the two lowered gates, the anxiety generated by not knowing when the train will appear, and the sense of guilt in knowing that bypassing the gate is illegal combine to increase the probability that the operator will not clear both gates.

When the vehicle strikes the gate arm the arm is usually broken and the vehicle damaged.

Devices within the scope of the present invention can be used for a variety of traffic control applications including applications as railroad crossing gates. In general a railroad crossing gate arm is pivoted in a vertical plane and is protected from movement in a horizontal plane by a shear pin located in the vertical pivot at the connected end of the gate arm. However, the pin arrangement is not always effective and in the event the arm is struck a particularly hard blow, the gate arm itself can break. Gate arm breakage is a common occurrence and repair cost is significant, not to mention the danger to traffic during periods when the gate is down so the crossing remains without a warning barrier in operable condition.

Even when the shear pin works to release the gate arm, the gate simply drops to the ground and is run over by passing vehicles negotiating the crossing. Heretofore, crossing gates have been made of single wooden boards, extruded tubular aluminum, fiberglass or composite materials so that they are severely damaged when run over by a vehicle.

Thus in either case when a crossing gate arm is struck by a vehicle hard enough to release the gate arm significant expense is incurred by the railroad in replacing the gate.

The problem has been addressed in several prior art patents such as U.S. Pat. Nos. 1,914,359 and 3,223,387. Hinged arrangements have been taught in U.S. Pat. Nos. 1,899,496 and 1,536,360. A ball and socket arrangement taught in U.S. Pat. No. 1,832,232 and a breakaway arrangement is taught in U.S. Pat. No. 4,090,685. Also, an arm arrangement with a shell and core is taught in U.S. Pat. No. 4,811,516 but does not teach an arrangement where the core and the inside of the shell are in virtually continuous contact as in the present invention. In general, the prior art arrangements require complex mechanical linkages and the like which are subject to wear, damage and deterioration due to the outdoor elements. Additionally, in the event of damage to the arrangements the cost of repair is increased not decreased.

Accordingly, no prior art device is known which provides the concept of the advantages of devices within the scope of the present invention.

SUMMARY OF THE INVENTION

The present invention provides new, useful and inexpensive means to address the many problems encountered in the use of crossing arm gates.

Moreover, devices within the scope of the present invention substantially reduce the damage which would otherwise occur when a vehicle attempts to bypass a lowered crossing gate in accordance with the present invention and strikes the end of the gate. Moreover, devices within the scope of the present invention can be provided with a "breakaway" device so that a segment of the crossing gate is released upon direct impact without breaking the gate arm or severing the shear pin. Additionally, gate arms within the scope of the present invention can be fabricated using a tubular shell and core construction where advantageously it has been found that by using a shell which is more flexible than the core and providing virtually continuous contact between the core periphery and the inner periphery of the shell an assembly is provided which substantially reduces the likelihood of destruction of the gate arm in the event it is overrun by traffic.

Moreover, in the event the gate arm is damaged beyond repair replacement of the damaged section is easily accomplished by a single worker.

Briefly, the present invention provides a vehicle control gate arrangement pivotable in a vertical plane for restricting the flow of vehicular traffic, where the gate is generally elongate and can include a tubular shell and a core member where the shell is more flexible than the core. The core can be terminated toward the distal end of the gate so that the shell extends outwardly from the termination of the core so that vehicles attempting to bypass the end of the gate but failing to do so strike the flexible end of the gate so the gate is not damaged or knocked down. An arrangement is also provided to include a gate composed of one or more sections where the sections are connected by a joint assembly or a single arm is connected to a pivot device so the arm or the outermost section of the arm is released in the event the section is struck by a vehicle attempting to go through the gate.

Arrangements within the scope of the present invention are illustrated in the accompanying drawings and described hereinafter but it will be understood that neither the illustrations of the examples nor the descriptions thereof are by way of limitation and that other arrangements also within the scope of the present invention will occur to those skilled in the art upon reading the disclosure set forth herein.

BRIEF DESCRIPTION OF THE DRAWINGS

Examples of arrangements within the scope of the present invention are illustrated in the accompanying drawings and described hereinafter where:

FIG. 6A1 is an enlarged illustration of a portion of the example of a clamping arrangement shown in FIGS. 3 and 6A.

DETAILED DESCRIPTION OF THE DRAWINGS

Figure 1:
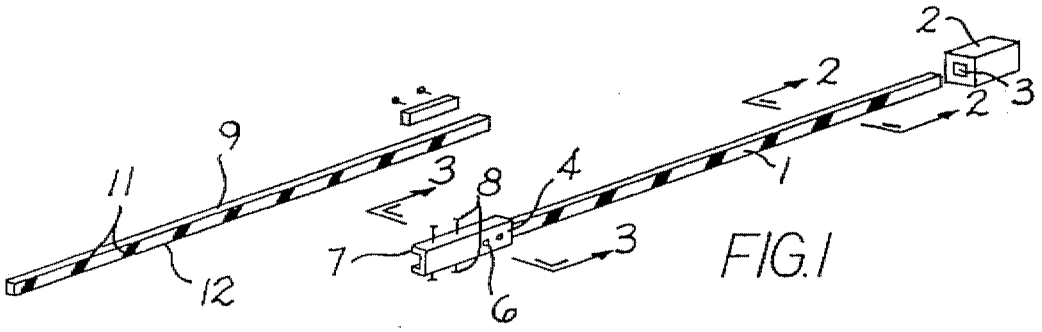
FIG. 1 is a perspective view in exploded section of an example of a gate arm within the scope of the present invention.

Referring first to FIG. 1, an example of a gate arm useful for controlling traffic at a railroad crossing or the like is illustrated. The gate arm has two segments, 1 and 9. In the arrangement shown, segment 1 is retained by a connector 2 having a recess 3 to accept and hold the arm section 1.

Typically, the connector 2 is part of a larger structure (not shown) which pivots the gate arm, in the case of a railroad crossing in a vertical plane, so the arm is selectively located to restrict flow of traffic as previously described.

The two arm segments 1 and 9 of the gate assembly are joined by a "breakaway" connector 4. As shown, connector 4 is fastened to the non-breakaway gate arm segment 1 by suitable fastener means 6 such as bolts. An outer plate 5 can be provided to be secured to the outer surface of the breakaway gate arm 9 in the area of connector 4 as described in more detail hereinafter.

In the examples shown in FIGS. 1, 3, 6A and 6B connector 4 has an opening 7 adapted to receive the end of segment 9 and a clamping means, examples of which are described hereinafter, to hold gate segment 9 securely in connector 4, for example by tightening clamping belts 8. While gate segment 9 is secured in connector 4 it is releasably secured so that upon impact of a vehicle with the segment 9 the segment is released from connector 4 rather than breaking so in many cases it is not necessary to provide shear pins.

Also within the scope of the present invention gate arm segments 1 and 9 can also be fabricated to substantially reduce the damage which might occur to the segments in the event they are impacted or overrun. It has been found that arrangements of the type shown in the figures where a shell is provided and a core provided within the shell as illustrated generally in FIG. 2, provides the strength necessary to prevent the arm from sagging while also unexpectedly providing substantial "crush" strength to minimize the likelihood of damage in the event the segment is run over by a vehicle.

Figure 2:
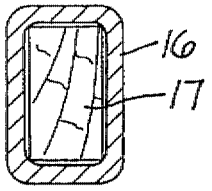
FIG. 2 is a cross-sectional view of an example of a gate arm assembly within the scope of the present invention.

FIG. 2 illustrates a configuration within the scope of the present invention where a shell 16 is provided with a core 17 located therein. While various materials of construction may be used within the scope of the present invention, a construction composed of an elastomeric shell and wood core has been found to perform quite well. It will, however be understood that other constructions such as a composite core with a plastic or aluminum shell is also within the scope of the present invention.

Figure 4:
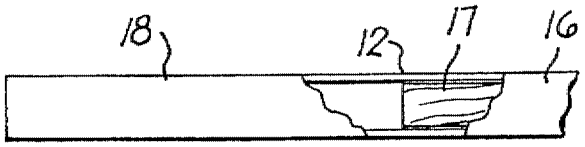
FIG. 4 is an illustration of one example of a flexible gate arm tip assembly within the scope of the present invention.

In accordance with another feature of the present invention as illustrated in FIG. 4, a flexible tip construction can be provided for the outermost arm segment.

As illustrated in FIG. 4, the core 17 has a termination 12 a selected distance from the end of the shell 16 so that because of the flexibility of shell 16 a flexible tip 18 is provided.

Figure 5:
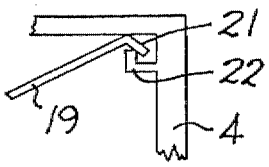
FIG. 5 is a top view illustrating one characteristic of tip assembly as shown in FIG. 4.
Figure 5:
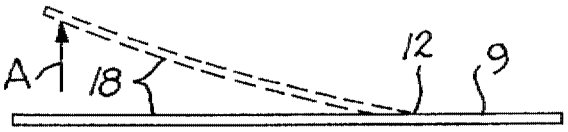

FIG. 5 illustrates the usefulness of the flexible tip 18 where if the end of the gate arm segment 9 is struck by a vehicle exerting a force "A" the flexible tip 18 deforms in the direction of the exerted force and the gate arm segment neither severs the pin nor is the gate arm broken.

Figure 3:
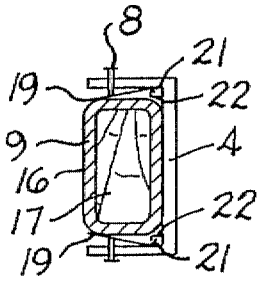
FIG. 3 shows a cross-sectional view of an example of a gate arm and breakaway connector within the scope of the present invention.
Figure 6A:
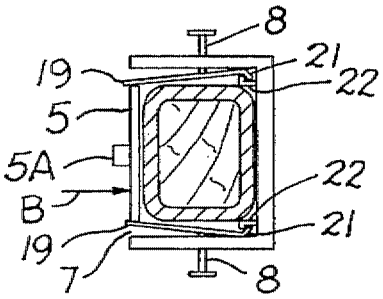
FIGS. 6A and 6B show illustrations of examples of "breakaway" gate arm connectors within the scope of the present invention.
Figure 6B:
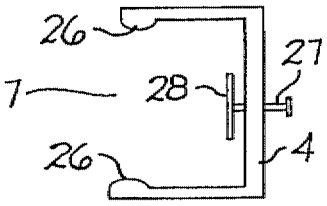

FIGS. 3, 6A and 6B illustrate examples of connectors within the scope of the present invention in cross section.

In FIG. 3 a gate arm section composed of shell 16 and core 17 is illustrated in a connector 4 where bolts 8 at the top and bottom of the connector bear on clamping plates 19 moving the clamping plates 19 into clamping position to pinch the arm assembly therebetween and hold the arm assembly in place in the connector. As shown in FIG. 1, two or more bolts 8 can be provided so that the arm is held securely and so that the bolts can be tightened in a manner to "level" the arm section 9 in the connector In FIG. 6A the connector frame 4 is provided with an internal lip 22 and a clamp plate 19 with a cooperative lip 21 to be pivotably received in lip 22. FIG. 6A1 shows the pivot assembly in more detail.

As also shown in FIG. 6A plate 5 can be secured to gate arm 9 by bolts 5A or other suitable fasteners and located so that the outer end of clamping members 19 engage the upper and lower edges of the plate so that as the bolts 8 are tightened the plate urges the arm assembly 16, 17 inwardly to connector 4 as illustrated by arrow "B".

In the event of impact the gate arm segment 12 can release from the clamp without breakage.

FIG. 6B illustrates another clamp arrangement within the scope of the present invention where the connector 4 is provided with beads 26 so that the gate arm segment is received in the connector between the beads and is retained by a clamp bar 28 and fasteners 27.

As shown, the gate arm segments can be provided with the cautionary striping 11 commonly provided even in the flexible tip area and it will also be understood that not all of the striping commonly used is shown.

It will be understood that the foregoing are but a few examples of arrangements within the scope of the present invention and that other arrangements also within the scope of the present invention will occur to those skilled in the art upon reading the disclosure set forth hereinbefore.

The invention claimed is:

1. A generally elongate vehicle control gate arm arrangement pivotable to a position for restricting flow of vehicular traffic, including:

a gate arm segment, comprising a tubular shell having a first end and a second end and defining a chamber therein defining an inner periphery having a selected cross-sectional shape;

a core defining an outer periphery having a cross-sectional shape substantially similar to the cross-sectional shape of the inner periphery of said chamber and a length less than the length of said tubular shell and received within said tubular shell so that a portion of the outer periphery of said core is in contact with the inner periphery of said tubular shell and wherein said core is terminated inwardly of said second end so that said tubular shell extends outwardly from said core a selected distance to provide a flexible end of said tubular shell so that vehicles attempting to bypass the second end of said gate arm segment strike said flexible end of said tubular shell.

2. A generally elongate vehicle control gate arm arrangement pivotable to a position for restricting flow of vehicular traffic, including:

a gate arm segment;

a connector including a clamp to releasably retain said gate arm segment and release said gate arm segment when said gate arm segment is impacted; said clamp including a channel shaped frame and a clamping plate which is movable with respect to said frame and which, in a clamping position, presses against at least one surface of said gate arm segment to clamp said gate arm segment on said channel shaped frame.

3. A generally elongate vehicle control gate arm arrangement pivotable to a position for restricting flow of vehicular traffic, including:

first and second gate arm segments;

a connector connecting together said first and second gate arm segments in end to end relation, said connector being fastened to said first gate arm segment and being clamped to said second gate arm segment so that, if said second gate arm segment is hit by a vehicle, said second gate arm segment is released from said connector, preventing damage to any portion of the gate arm arrangement.

4. A generally elongate vehicle control gate arm arrangement as recited in claim 3, wherein said connector includes a pivotable plate for clamping said second gate arm segment.

5. A breakaway connector and breakaway gate arm segment combination, comprising:

a frame for receiving a breakaway gate arm segment and another gate arm segment in end-to-end arrangement;

said breakaway gate arm segment having first and second ends and an outer surface;

a clamp on said frame for releasably clamping said connector to said breakaway gate arm segment;

wherein said clamp includes a movable portion that presses against the outer surface of the first end of said breakaway gate arm segment, thereby clamping the first end of said breakaway gate arm segment on said frame, such that, if said breakaway gate arm segment is hit by a vehicle, the clamp will release said breakaway gate arm segment, preventing damage to the connector; and at least one fastener on said frame for fixing said connector to said another gate arm segment.

6. A breakaway connector and breakaway gate arm segment combination, as recited in claim 5, wherein said breakaway gate arm segment comprises:

an elongated shell; and an elongated core inside said shell, wherein the material of the shell is more flexible than the material of the core.

7. A breakaway connector and breakaway gate arm segment combination as recited in claim 6, and further comprising a substantially rigid plate on said first end which is gripped by said clamp so as to releasably secure said breakaway gate arm segment to said connector.

8. A breakaway connector and breakaway gate arm segment combination as recited in claim 6, wherein said core terminates short of said second end, so that the second end portion having no core is more flexible than the first end of said breakaway gate arm segment, which has the core.

9. A breakaway connector and breakaway gate arm segment as recited in claim 5, in combination with said another gate arm segment, wherein said breakaway connector is fastened to said another gate arm segment, holding said gate arm segments together in end-to-end relation such that, if said breakaway gate arm segment is hit, it is released from said connector, preventing damage to the connector and the arm segments.

10. An elongated vehicle control gate arm pivotable to a position for restricting the flow of vehicular traffic, including:

first and second gate arm segments;

a connector which holds said first and second gate arm segments together and is clamped to said second gate arm segment to releasably retain said second gate arm segment;

wherein said connector includes a movable plate which presses against said second gate arm segment to clamp said second gate arm segment to said connector;

said second gate arm segment including a tubular shell and a core, wherein said tubular shell is more flexible than said core.

11. An elongated vehicle control gate arm as recited in claim 10, wherein said connector holds said first and second gate arm segments together in end-to-end relation.

12. An elongated vehicle control gate arm as recited in claim 10, wherein said second gate arm segment is clamped to said connector at one end, and the other end is free, and wherein said core terminates short of said free end, leaving said free end which does not have the core more flexible than the one end of said second gate arm segment, which has the core.

13. An elongated vehicle control gate arm having first and second ends, comprising:

a flexible shell having first and second ends;

a core inside said flexible shell, wherein said flexible shell extends beyond said core at said second end, so that said second end of said gate arm which does not have the core is more flexible than said first end of the gate arm which has the core.

* * * * *